US008920581B2

(12) United States Patent
Natori et al.

(10) Patent No.: US 8,920,581 B2
(45) Date of Patent: Dec. 30, 2014

(54) GRAIN-ORIENTED ELECTRICAL STEEL SHEET AND MANUFACTURING METHOD THEREOF

(75) Inventors: Yoshiaki Natori, Tokyo (JP); Shuichi Yamazaki, Tokyo (JP); Fumiaki Takahashi, Tokyo (JP); Seiki Takebayashi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 283 days.

(21) Appl. No.: 13/127,731

(22) PCT Filed: Sep. 30, 2009

(86) PCT No.: PCT/JP2009/067017

§ 371 (c)(1),
(2), (4) Date: May 5, 2011

(87) PCT Pub. No.: WO2010/070965

PCT Pub. Date: Jun. 24, 2010

(65) Prior Publication Data

US 2011/0209798 A1 Sep. 1, 2011

(30) Foreign Application Priority Data

Dec. 16, 2008 (JP) ..... 2008-320109

(51) Int. Cl.

| | |
|---|---|
| ***C23C 8/26*** | (2006.01) |
| ***C21D 1/76*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |
| ***C23C 8/24*** | (2006.01) |
| ***C23C 8/80*** | (2006.01) |

(52) U.S. Cl.

CPC ... *C23C 8/26* (2013.01); *C21D 1/76* (2013.01); *C21D 8/1283* (2013.01); *C22C 38/001* (2013.01); *C22C 38/004* (2013.01); *C22C 38/02* (2013.01); *C22C 38/04* (2013.01); *C22C 38/06* (2013.01); *C22C 38/34* (2013.01); *C23C 8/24* (2013.01); *C23C 8/80* (2013.01)

USPC ..... 148/232; 148/318

(58) Field of Classification Search

CPC ..... C23C 8/26

USPC ..... 148/232, 318

See application file for complete search history.

(56) References Cited

U.S. PATENT DOCUMENTS 4,127,429 A * 11/1978 Ichida et al. ..... 148/113
5,082,509 A * 1/1992 Ushigami et al. ..... 148/111

(Continued)

FOREIGN PATENT DOCUMENTS

JP 5-171284 A 7/1993
JP 7-62443 A 3/1995

(Continued)

OTHER PUBLICATIONS

International Search Report, PCT/JP2009/067017, Dec. 15, 2009.

(Continued)

*Primary Examiner* — Jessee Roe

(74) *Attorney, Agent, or Firm* — Birch, Stewart, Kolasch & Birch, LLP

(57) ABSTRACT

Nitriding process of a steel strip is performed. Next, annealing is performed to form a forsterite based glass coating film at a surface of the steel strip. Heating is performed up to 1000° C. or more in a mixed gas atmosphere containing $H_2$ gas and $N_2$ gas, and a rate of $N_2$ gas is 20 volume % or more, next, the atmosphere is switched into $H_2$ gas atmosphere at the temperature of 1000° C. or more and 1100° C. or less, when the annealing is performed. An oxygen potential P ($H_2O$)/P ($H_2$) is set to be 0.05 to 0.3 when the temperature is 850° C. or less during the heating in the mixed gas atmosphere.

2 Claims, 4 Drawing Sheets

(56) References Cited

U.S. PATENT DOCUMENTS

| | | | | |
|---|---|---|---|---|
| 5,507,883 | A | 4/1996 | Tanaka et al. | |
| 5,571,342 | A * | 11/1996 | Komatsubara et al. | 148/308 |
| 6,039,818 | A | 3/2000 | Toge et al. | |
| 6,331,215 | B1 | 12/2001 | Toge et al. | |
| 6,835,250 | B2 * | 12/2004 | Hiratsu et al. | 148/27 |
| 6,899,768 | B2 * | 5/2005 | Toutsuka et al. | 148/27 |
| 7,833,360 | B2 | 11/2010 | Kumano et al. | |
| 2004/0069377 | A1 * | 4/2004 | Fortunati et al. | 148/111 |
| 2008/0271819 | A1 * | 11/2008 | Nanba et al. | 148/111 |
| 2009/0032142 | A1 * | 2/2009 | Kumano et al. | 148/111 |

FOREIGN PATENT DOCUMENTS

| | | | |
|---|---|---|---|
| JP | 2691828 | B2 | 12/1997 |
| JP | 2762105 | B2 | 6/1998 |
| JP | 10-245629 | A | 9/1998 |
| JP | 11-279644 | A | 10/1999 |
| JP | 2000-63950 | A | 2/2000 |
| JP | 3483457 | B2 | 1/2004 |
| JP | 2004-211145 | A | 7/2004 |
| JP | 2006-161106 | A | 6/2006 |
| JP | 2007-238984 | A | 9/2007 |

OTHER PUBLICATIONS

Chinese Office Action for Application No. 200980150642.7 dated Oct. 19, 2012.

Zhongzhi, "Electrical Steel", Metallurgical Industry Press, Mar. 1997, pp. 573-694 (with partial English translation).

* cited by examiner

GRAIN-ORIENTED ELECTRICAL STEEL SHEET AND MANUFACTURING METHOD THEREOF

TECHNICAL FIELD

The present invention relates to a grain-oriented electrical steel sheet, and a manufacturing method thereof suitable for an iron core of electric equipments such as a voltage transformer and an electric transformer.

BACKGROUND ART

In a conventional manufacturing method of a grain-oriented electrical steel sheet, an insulating film called as a glass coating film is formed at a surface of a steel strip at finish annealing, and a control of a crystal orientation using AlN precipitates as an inhibitor is performed. A tensile tension acts on the steel strip by the glass coating film, and thereby, a core loss of the grain-oriented electrical steel sheet is reduced. There is a case when the glass coating film is called as a forsterite film or a primary coating film. Besides, excitation properties improve owing to the control of the crystal orientation.

However, there is a case when a number of defects occur at the glass coating film in the conventional manufacturing method as stated above. A size of the defect in a direction parallel to the surface of the steel strip is several dozen μm to several hundred μm. If the defect as stated above occurs, an external appearance deteriorates because the steel strip exposes from the glass coating film. Besides, the defect of the glass coating film leads to the core loss and/or deterioration of the excitation properties.

A study to reduce the defects of the glass coating film has been made, but it is impossible to fully reduce the defects by the former technologies.

CITATION LIST

Patent Literature

Patent Document 1: Japanese Laid-open Patent Publication No. 2006-161106
Patent Document 2: Japanese Laid-open Patent Publication No. 2000-63950
Patent Document 3: Japanese Laid-open Patent Publication No. H10-245629
Patent Document 4: Japanese Laid-open Patent Publication No. 2007-238984
Patent Document 5: Japanese Laid-open Patent Publication No. H05-171284

SUMMARY OF THE INVENTION

Technical Problem

An object of the present invention is to provide a grain-oriented electrical steel sheet and a manufacturing method thereof capable of fully reducing detects of a glass coating film.

Solution to Problem

The present inventors focused attention on a relationship between the defects of the glass coating film and a structure of the glass coating film, and observed a cross-sectional structure of the glass coating film in detail. As a result, it turned out that there is a portion of which thickness becomes thick for a wide range (aggregated portion) in the glass coating film, and the defects are easy to occur as the number of the aggregated portions becomes large. The inventors came to have knowledge that it is possible to suppress the defects of the glass coating film by suppressing the occurrence of the aggregated portions. The aggregated portion is described later.

The present invention is made based on the knowledge as stated above, and a summary thereof is as described below.

A grain-oriented electrical steel sheet according to the present invention includes: a steel strip; and a forsterite based glass coating film formed at a surface of the steel strip, in which when a portion of which thickness is continuously twice or more as thick as average thickness of the glass coating film, and of which size in a direction parallel to the surface of the steel strip is 3 μm or more is defined as an aggregated portion, a ratio of a total length of the aggregated portions crossed by a line segment relative to a length of the line segment is set to be 0.15 or less in an arbitrary line segment parallel to the surface of the steel strip.

A manufacturing method of a grain-oriented electrical steel sheet according to the present invention includes: performing nitriding process of a steel strip; and performing annealing to form a forsterite based glass coating film at a surface of the steel strip, in which the performing annealing includes: performing heating up to 1000° C. or more in a mixed gas atmosphere containing $H_2$ gas and $N_2$ gas, and a rate of $N_2$ gas is 20 volume % or more; and switching the atmosphere into $H_2$ gas atmosphere at the temperature of 1000° C. or more and 1100° C. or less, in which an oxygen potential P ($H_2O$)/P ($H_2$) is set to be 0.05 to 0.3 when the temperature is 850° C. or less during the heating in the mixed gas atmosphere.

Advantageous Effects of Invention

According to the present invention, it is possible to effectively suppress defects of a glass coating film. A yield is thereby improved and a cost can be reduced. Besides, it is possible to stably manufacture grain-oriented electrical steel sheets.

DESCRIPTION OF EMBODIMENTS

As stated above, the present inventors focused attention on a relationship between defects of a glass coating film and a structure of the glass coating film, and observed a cross-sectional structure of the glass coating film in detail. As a result, it turned out that there is a portion of which thickness becomes thick for a wide range (aggregated portion) in the glass coating film, and the defects are easy to occur as the number of the aggregated portions increases. The inventors came to have knowledge that it is possible to suppress the defects of the glass coating film by suppressing the occurrence of the aggregated portion.

The present inventors further studied hard as for a manufacturing method of a grain-oriented electrical steel sheet based on the knowledge as stated above. As a result, it turned out that it is possible to suppress the occurrence of the aggregated portion and to suppress the defects of the glass coating film by switching an atmosphere at finish annealing from a mixed gas atmosphere containing hydrogen into a hydrogen gas atmosphere during heating.

Figure 1:
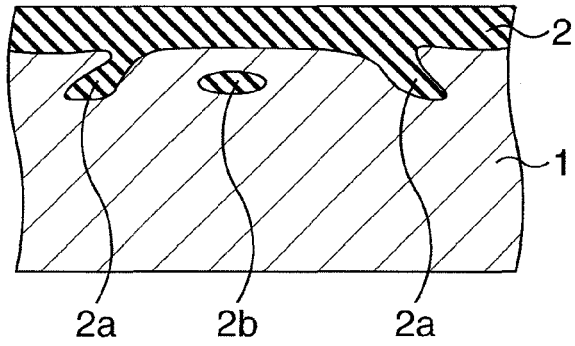
FIG. 1 is a sectional view illustrating a structure of a glass coating film.
Figure 2:
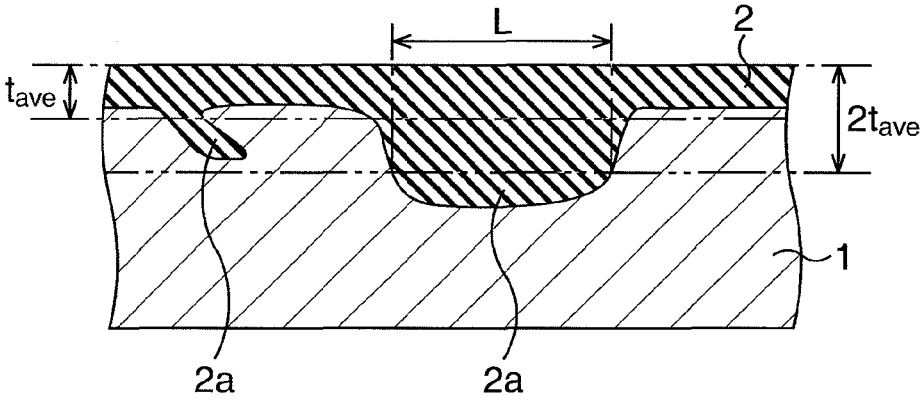
FIG. 2 is a sectional view illustrating an aggregated portion of a glass coating film.
Figure 3:
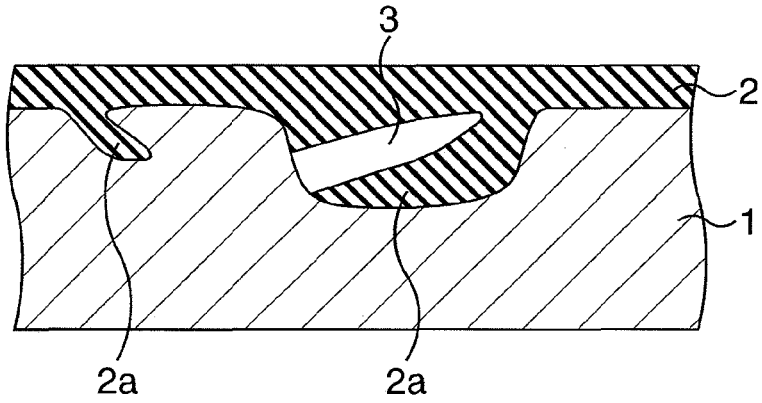
FIG. 3 is a sectional view illustrating a cavity of a glass coating film.

Here, a cross-sectional structure of a glass coating film and an aggregated portion are described. FIG. 1 is a sectional view illustrating a structure of a glass coating film. Though details are described later, a glass coating film is formed by oxidation of a surface of a steel strip. Accordingly, thickness of a glass coating film 2 does not become uniform as illustrated in FIG. 1, and there are entering portions (teeth portions) 2*a* entering into the surface of the steel strip 1 and a floating portion 2*b* floating in a vicinity of the surface of the steel strip 1 at the glass coating film 2. Sizes of the entering portion 2*a* and the floating portion 2*b* are various, and there is a case when a particularly large entering portion 2*a* exists as illustrated in FIG. 2. In the present invention, a portion satisfying the following conditions among the glass coating film is called as the aggregated portion as for the large entering portion 2*a* as stated above. In the present invention, the aggregated portion of the glass coating film is a portion of which thickness is continuously twice or more as thick as average thickness $t_{ave}$ of the glass coating film, and a size L in a direction parallel to the surface of the steel strip is 3 μm or more. Note that there is a case when a cavity 3 exists inside the glass coating film 2 as illustrated in FIG. 3. In this case, the thickness of the glass coating film 2 is determined while regarding that the cavity 3 is also a part of the glass coating film 2. For example, the average thickness of the glass coating film 2 is approximately 0.5 μm to 2 μm, a depth of the entering portion 2*a* which is not included in the aggregated portion is approximately 0.5 μm to 3 μm, and the size L is approximately 0.5 μm to 2 μm. The reason why the size L of the aggregated portion is set to be 3 μm or more is to distinguish from the entering portion 2*a* of which size L is approximately 0.5 μm to 2 μm.

Figure 4:
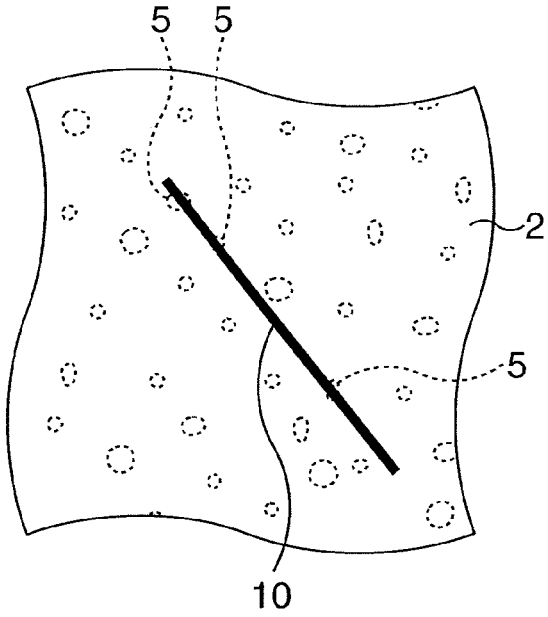
FIG. 4 is a plan view illustrating an example of a grain-oriented electrical steel sheet.

In the present invention, a ratio of a total length of the aggregated portion crossed by a line segment relative to a length of the line segment (aggregated portion ratio) is set to be 0.15 or less in an arbitrary line segment parallel to the surface of the steel strip. A plan view of an example of the grain-oriented electrical steel sheet is illustrated in FIG. 4. For example, as illustrated in FIG. 4, when an arbitrary line segment 10 parallel to the surface of the steel strip is defined in the glass coating film 2, and this line segment 10 crosses three pieces of aggregated portions, a ratio of a total length (aggregated portion ratio) of portions crossed by the line segment 10 relative to a length of the line segment 10 is set to be 0.15 or less. Note that the length of the line segment 10 is not limited in particular, but there are variations in sizes and localization of the aggregated portions, and therefore, there is a possibility that the effect of the variation becomes large if the length of the line segment 10 is too short. It can be said that it is possible to obtain an appropriate statistical result while being scarcely affected by the variation if the length of the line segment 10 is set to be 500 μm or more according to experiences of the present inventors. This numerical limitation reason is described later.

Note that a measurement method of the length of the line segment and the length of the aggregated portion is not particularly limited, but for example, it is possible to measure these lengths by cutting out samples from the grain-oriented electrical steel sheet, and observing cross sections thereof.

When the observation as stated above is performed, it is desirable to polish the cross section, but the aggregated portion of the glass coating film is easy to be broken by the polishing compared to the other portions. Accordingly, it is desirable to perform polishing by using ion beams such as an FIB (Focused Ion Beam) and a CP (Cross-section Polisher) as finish polishing. Besides, it is desirable to use the one after formation of the glass coating film and before formation of an insulative coating film as the sample.

Figure 5:
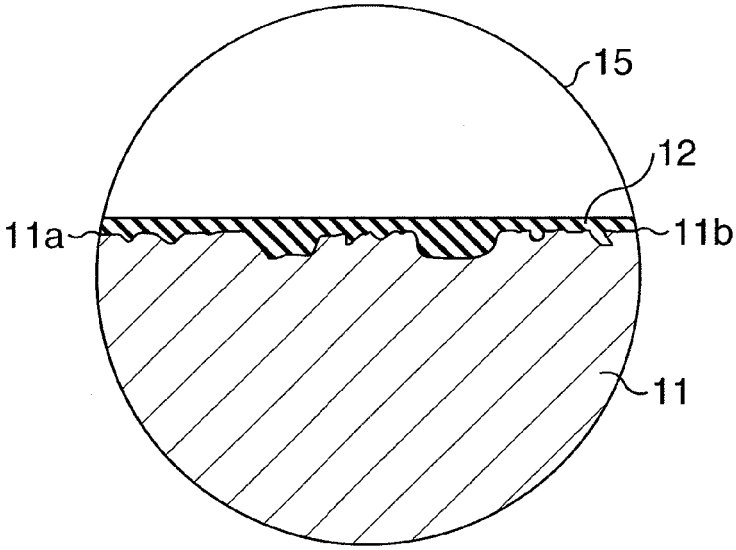
FIG. 5 is a view illustrating a visual field in microscope observation.

A microscope observation of the cross section of the sample is performed, a distance between both ends 11*a* and 11*b* of the surface of a steel strip 11 within a visual field 15 is regarded as the length of the line segment 10, and the total length of the aggregated portions of a glass coating film 12 existing within the visual field 15 in a direction parallel to the line segment 10 is found, and the aggregated portion ratio is calculated from the above as illustrated in FIG. 5.

Next, the numerical limitation reason of the aggregated portion ratio is described.

The present inventors manufactured samples from eight pieces of grain-oriented electrical steel sheets in coil states, and found a relationship between the aggregated portion ratio and defect of the glass coating film as for respective samples. Note that seven pieces from among the eight pieces of the grain-oriented electrical steel sheets were manufactured by a conventional method, and one piece was manufactured by a later-described method.

The aggregated portion ratios were found at three points in a width direction and four points in a longitudinal direction as for five pieces among the eight pieces of the grain-oriented electrical steel sheets. Besides, the aggregated portion ratios were found at three points in the width direction and five points in the longitudinal direction as for the remaining three pieces. The aggregated portion ratios were found at total of 105 points.

Besides, the number of defects (a) generated at the glass coating film existing per 1 $cm^2$ was measured, and it was evaluated by six stages illustrated in table 1.

TABLE 1

| EVALUATION | THE NUMBER OF DEFECTS (a) |
|---|---|
| 0 | 0 |
| 1 | $0 < a \leq 1$ |
| 2 | $1 < a \leq 10$ |
| 3 | $10 < a \leq 20$ |
| 4 | $20 < a \leq 50$ |
| 5 | $50 < a$ |

Besides, an average value of evaluation results in the table 1 was calculated by every 0.02 of the aggregated portion ratio to reduce the variation of data. For example, the average value of the evaluation results of the aggregated portion ratio existing within a range of larger than 0.29 and 0.31 or less was calculated as an evaluation when the aggregated portion ratio was 0.3.

Figure 6:
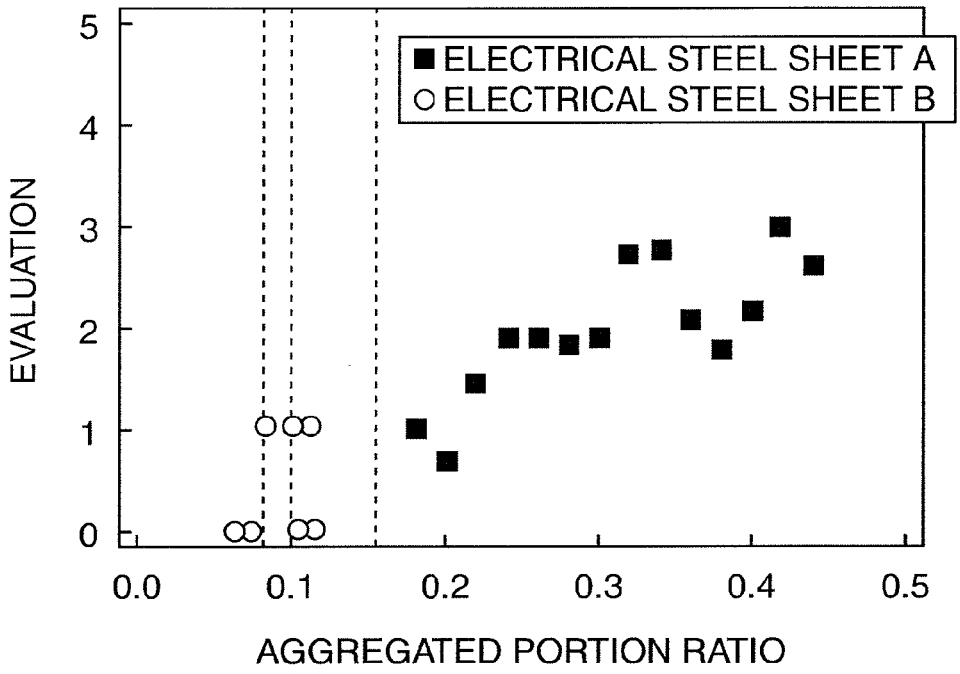
FIG. 6 is a view illustrating a relationship between an aggregated portion ratio and an evaluation of a glass coating film.

Note that samples of 10 mm×10 mm were manufactured from the above-stated 105 points, and the number of defects (a) existing at the surfaces thereof were counted in these observations. Next, a cross sectional observation of the sample was performed, and the aggregated portion ratio was found. In the cross sectional observation, the total length of the aggregated portions within a range of 500 μm parallel to the surface of the steel strip was measured. The result is illustrated in FIG. 6. An electrical steel sheet A in FIG. 6 represents a result of the sample manufactured from the grain-oriented electrical steel sheet manufactured by the conventional method, and an electrical steel sheet B represents a result of the sample manufactured from the grain-oriented electrical steel sheet manufactured by the later-described method.

As illustrated in FIG. 6, the better evaluation could be obtained as the aggregated portion ratio was smaller. Besides, the aggregated portion ratio exceeded 0.15 in the electrical steel sheet A, but the aggregated portion ratio was 0.15 or less in the electrical steel sheet B. When the aggregated portion ratio was 0.15 or less, the evaluation was good as only "0" (zero) or 1. Besides, when the aggregated portion ratio was 0.1 or less, the particularly good evaluation as (0) (zero) was easy to be obtained, and the evaluation was only "0" (zero) when the aggregated portion ratio was 0.09 or less. Accordingly, the aggregated portion ratio is set to be 0.15 or less, it is preferable to be 0.1 or less, and particularly preferable to be 0.09 or less.

Note that it is conceivable that the defect of the glass coating film is generated because nitrogen gas accumulates on an interface between the glass coating film and the steel strip. Accordingly, it is conceivable that the defect of the glass coating film is easy to occur as there are many portions where the nitrogen gas is easy to accumulate. On the other hand, as a result of the observation, it turned out that there are cavities 3 as illustrated in FIG. 3 in many aggregated portions. It is conceivable that the reason why the defects of the glass coating film increase as the aggregated portion ratio becomes large is because the aggregated portion has a structure easy to accumulate the nitrogen gas.

Figure 7:
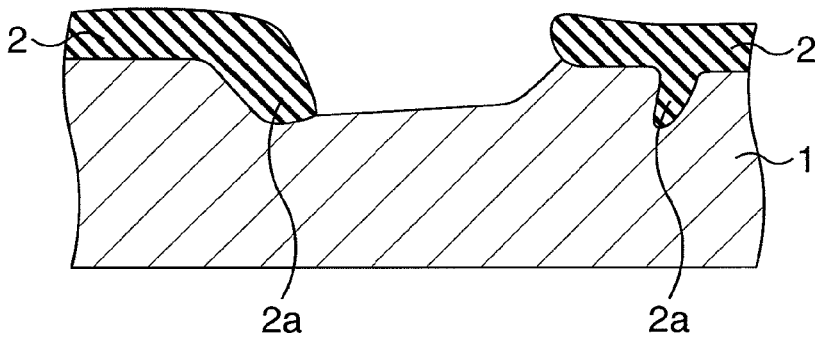
FIG. 7 is a sectional view illustrating a breakage of a glass coating film.

Note that there is a case when a part of the glass coating film 2 is broken and the steel strip exposes as illustrated in FIG. 7 during the sample to observe the aggregated portion is manufactured and so on. In this case, a judgment whether the portion corresponds to the aggregated portion or not is performed in consideration of the thickness of the glass coating film 2 remaining around the portion, while regarding that the glass coating film 2 with the thickness corresponding to the aggregated portion exists at the portion where the defect of the glass coating film 2 occurs. For example, when the size L of the defect portion is 3 μm or more, it can be judged that there exists the aggregated portion. Besides, it can be judged that there exists the aggregated portion when there is a portion of which thickness is twice or more as thick as the average thickness $t_{ave}$ adjacent to the defect portion, and a sum of these sizes L is 3 μm or more even if the size L of the defect portion is less than 3 μm.

Besides, it is desirable that the observation of the sample is performed before the formation of the insulative coating film, but it may be performed after the formation of the insulative coating film. In this case, the observation of the sample is performed after the insulative coating film is removed by a general chemical process. There is a case when a part of the glass coating film 2 is defected as illustrated in FIG. 7 when the insulative coating film is removed, but it is possible to determine presence/absence and the size of the aggregated portion based on the judgment as stated above.

(Manufacturing Method of Grain-Oriented Electromagnetic Steel Sheet)

Figure 8:
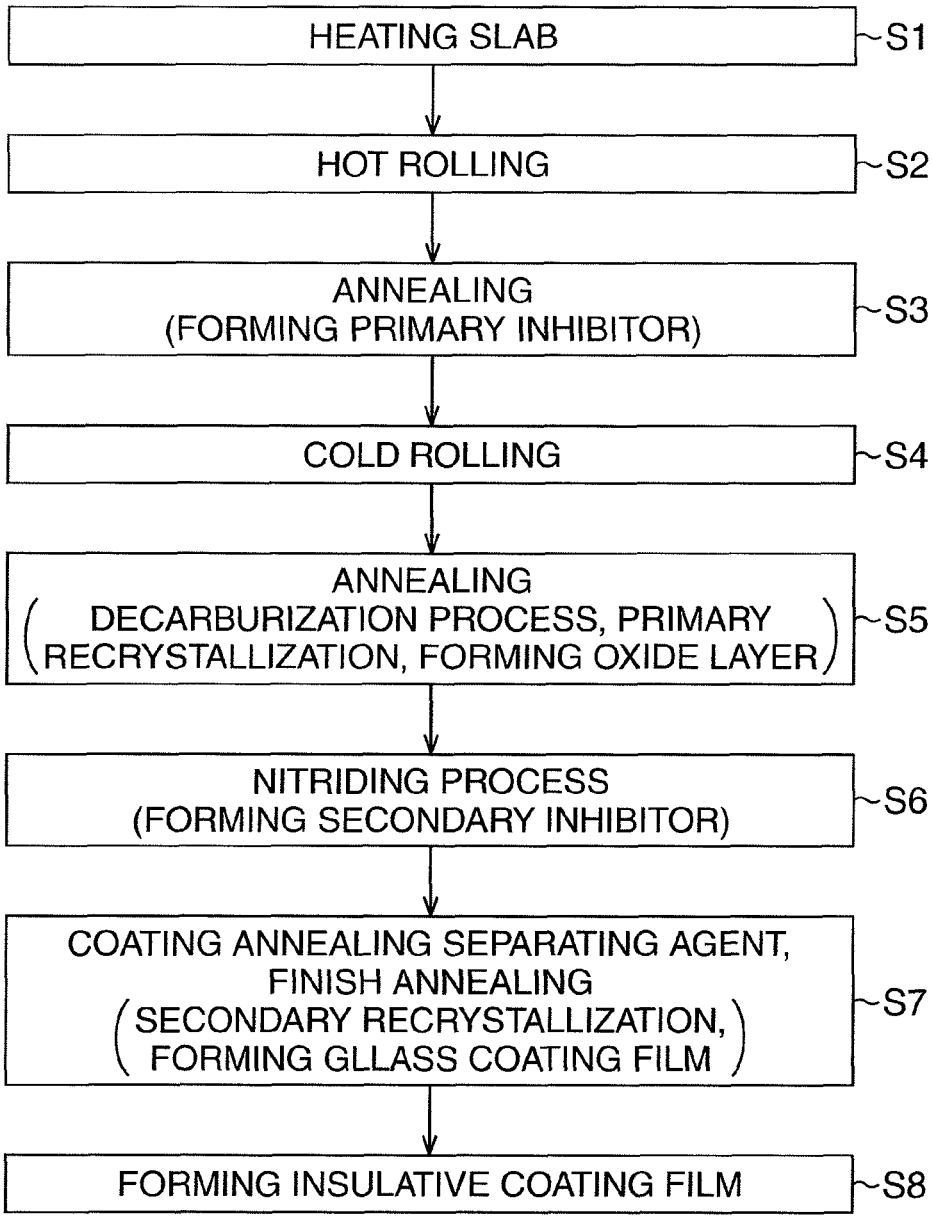
FIG. 8 is a flowchart illustrating a manufacturing method of a grain-oriented electrical steel sheet.

Next, a method suitable for manufacturing a grain-oriented electrical steel sheet as stated above is described. FIG. 8 is a flowchart illustrating a manufacturing method of a grain-oriented electrical steel sheet.

Heating of a slab with a predetermined composition is performed (step S1), and a substance functioning as an inhibitor is solid-solved.

Next, hot rolling is performed to obtain a steel strip (hot-rolled steel strip) (step S2). Fine AlN precipitates are formed in the hot rolling.

After that, annealing of the steel strip (hot-rolled steel strip) is performed, and the precipitates such as AlN (primary inhibitor) are formed with an adequate size and amount (step S3).

Subsequently, cold rolling of the steel strip after the annealing at the step S3 (first annealed steel strip) is performed (step S4). The cold rolling may be performed only once, or plural times of cold rolling may be performed while performing intermediate annealing therebetween. When the intermediate annealing is performed, the annealing at the step S3 may not be performed, and the primary inhibitor is formed in the intermediate annealing.

Next, annealing of the steel strip after the cold rolling (cold-rolled steel strip) is performed (step S5). In this annealing, decarburization is performed, and further, primary recrystallization occurs and an oxide layer is formed on a surface of the cold-rolled steel strip.

After that, nitriding process of the steel strip after the annealing at the step S5 (second annealed steel strip) is performed (step S6). Namely, introduction of nitrogen to the steel strip is performed. For example, heat treatment in nitrogen gas containing atmosphere such as ammonia can be cited as a way to introduce nitrogen. The precipitates such as AlN (secondary inhibitor) are formed in the nitriding process. It is desirable that an amount of nitrogen contained in the steel strip after the nitriding process is 100 ppm or more. It is to obtain good magnetic properties by performing a control of secondary recrystallization (step S7) appropriately.

Subsequently, annealing separating agent is coated on a surface of the steel strip after the nitriding process (nitriding steel strip), and thereafter, finish annealing is performed (step S7). The secondary recrystallization occurs, and further, a glass coating film (called also as a primary coating film, a forsterite coating film) is formed on the surface of the steel strip, in the finish annealing. Note that the nitriding process (step S6) may be performed in the finish annealing by making the annealing separating agent contain FeN and/or MnN. Namely, the nitriding process may be performed by using nitrogen generated by decomposition of FeN and/or MnN. Besides, various elements may be added to the annealing separating agent to improve properties of the glass coating film. Though details of conditions of the finish annealing are described later, heating (heat treatment), soaking, cooling (cooling treatment) are performed.

Next, an insulative coating film (called also as a secondary coating film) is formed on the glass coating film by coating and baking insulative coating agent (step S8). Formation of the insulative coating film is performed after the cooling (cooling treatment) in the finish annealing (step S7). It is possible to effectively add tension to the steel strip by using coating solution of which major constituent is colloidal silica and phosphate as the insulative coating agent and it is effective to further improve core loss.

Note that irradiation of laser light having a magnetic domain refining effect, or formation of grooves may be performed to further improve the core loss. In these cases, the grain-oriented electrical steel sheet having better magnetic properties can be obtained.

(Composition of Slab)

Next, composition of slab is described.

C: 0.005 Mass % or Less

When C content exceeds 0.005%, the magnetic properties are easy to deteriorate caused by magnetic aging. Accordingly, it is preferable that the C content is set to be 0.005% or less. On the other hand, a suppression effect of the deterioration of the magnetic properties does not become large if the C content is reduced less than 0.0001 mass %. Accordingly, the C content may be 0.0001 mass % or more.

Si: 2.0 Mass % to 7.0 Mass %

When content of Si is less than 2.0 mass %, good core loss is difficult to be obtained. When the content of Si exceeds 7.0 mass %, the cold rolling (step S4) is easy to be difficult. Accordingly, the content of Si is desirable to be set at 2.0 mass % to 7.0 mass %.

The other elements many be contained to improve various properties of the grain-oriented electrical steel sheet. Besides, it is preferable that the remaining of the slab is composed of Fe and inevitable impurities.

(Glass Coating Film)

Next, the glass coating film is described. As stated above, the aggregated portion ratio of the glass coating film is set to be 0.15 or less. Besides, the aggregated portion ratio is preferable to be 0.10 or less. This is to effectively suppress the defects of the glass coating film even when there are variations in the other factors (the conditions of the annealing at the step S5 and/or the conditions of the finish annealing at the step S7, and so on). Note that the composition of the glass coating film is not particularly limited, but a major constituent of the annealing separating agent used in the finish annealing is, for example, MgO, and MgO of 90 mass % or more is contained. Accordingly, the major constituent of the glass coating film is, for example, forsterite ($Mg_2SiO_4$), and spinel ($MgAl_2O_4$) is contained.

(Finish Annealing (Step S7))

Next, the finish annealing is described. In the present invention, the heating is started from a temperature of 850° C. or less, and the soaking is performed at 1150° C. to 1250° C.

Atmosphere gas is set to be mixed gas of $H_2$ gas and $N_2$ gas, and a rate of $N_2$ gas is set to be 20 volume % or more within a temperature range of 850° C. or less. Besides, oxygen potential (P ($H_2O$)/P ($H_2$)) is set to be 0.05 to 0.3. Here, P ($H_2O$) is a partial pressure of $H_2O$, and P ($H_2$) is a partial pressure of $H_2$.

The atmosphere gas is set to be the mixed gas of $H_2$ gas and $N_2$ gas, and the rate of $N_2$ gas is set to be 20 volume % or more within a temperature range of higher than 850° C. and less than 1000° C. Incidentally, the oxygen potential is not particularly limited.

The atmosphere gas is set to be $H_2$ gas atmosphere within a temperature range of 1000° C. or more and 1100° C. or less. The soaking process is also performed in the $H_2$ gas atmosphere.

The reason why the rate of $N_2$ gas before the atmosphere gas is switched into the $H_2$ gas atmosphere is set to be 20 volume % or more is to suppress denitrification from the steel strip. When the denitrification excessively occurs, the inhibitor in the steel strip goes short, and an orientation of crystal obtained by the secondary recrystallization is easy to go out of order. The glass coating film also has an effect to suppress the denitrification, but this effect is small because the formation of the glass coating film is not enough if the temperature is less than 1000° C. Accordingly, the rate of $N_2$ gas is set to be 20 volume % or more when the temperature is less than 1000° C.

On the other hand, $H_2$ gas is also necessary before the atmosphere gas is switched into the $H_2$ gas atmosphere. This is to keep the oxygen potential appropriately. In particular, the oxygen potential is easy to affect on the oxide layer formed in the annealing (step S5) in a low-temperature range of 850° C. or less. When the oxygen potential is less than 0.05, the oxide layer becomes thin caused by reduction, and therefore, the glass coating film is not enough formed. When the oxygen potential exceeds 0.3, the glass coating film becomes too thick to be easy to peel off from the steel strip. Besides, MgO hydrated water in the annealing separation agent is released into the atmosphere gas as vapor during the heating. Accordingly, there is a case when the oxygen potential becomes too high if $H_2$ gas is not contained. $H_2$ gas is therefore to be contained in the atmosphere gas when the temperature is 1000° C. or less. Note that it is desirable that the rate of $N_2$ gas is 75 volume % or less because $H_2$ gas is contained in the atmosphere gas. It is further preferable if the rate of $N_2$ gas is 50 volume % or less.

The reason why the temperature to switch the atmosphere gas is set to be 1000° C. or more is because the denitrification is easy to occur as stated above, and $SiO_2$ in the oxide layer formed in the annealing (step S5) is adversely affected if the atmosphere gas is switched at the temperature of less than 1000° C. The glass coating film is not enough formed at the temperature of less than 1000° C. Accordingly, reduction property of the atmosphere becomes too strong for $SiO_2$ in the oxide layer if the atmosphere gas is switched into the $H_2$ gas atmosphere under this state. As a result, $SiO_2$ is adversely affected, and it becomes difficult to form a good glass coating film. The temperature to switch the atmosphere gas is therefore set to be 1000° C. or more.

The reason why the temperature to switch the atmosphere gas is set to be 1100° C. or less is to effectively suppress formation reaction of the glass coating film. Though the reason why the formation of the aggregated portion of the glass coating film is suppressed when the switching is performed at 1100° C. or less is not clear, it is conceivable that the atmosphere gas affects on a reaction behavior of the glass coating film at a deep portion from the surface of the steel strip. It is necessary to switch the atmosphere gas at an earlier stage before the reaction completes to more effectively control the formation reaction of the glass coating film. The earlier the switching is performed, the higher control effect can be expected. Accordingly, it is desirable to switch the atmosphere gas into the $H_2$ gas atmosphere within the temperature range of 1000° C. or more and 1050° C. or less to obtain further higher effect. The finish annealing (step S7) is brought forward under the conditions as stated above, and thereby, the preferred glass coating film is obtained after the finish annealing is completed. Namely, the glass coating film of which aggregated portion ratio is 0.15 or less, desirably 0.10 or less can be obtained. As a result, the defects of the glass coating film are suppressed, and the grain-oriented electrical steel sheet having fine coating properties and magnetic properties can be obtained.

Note that a composition of the inhibitor is not limited in particular. For example, nitride other than AlN (BN, $Nb_2N$, $Si_3N_4$, and so on) may be used. Besides, two or more kinds among the above may be contained in the steel strip.

Besides, the manufacturing method is not limited to the one illustrated in the flowchart in FIG. 8, and for example, the formation of the inhibitor may be only once. Incidentally, the effect of the present invention becomes remarkable when the formations of the inhibitor are twice. It is conceivable because a generation amount of nitrogen gas becomes large.

EXAMPLE

Example 1

A slab containing C: 0.05 mass %, Si: 3.2 mass %, Mn: 0.09 mass %, P: 0.02 mass %, S: 0.006 mass %, Al: 0.026 mass %, N: 0.009 mass %, and Cr: 0.1 mass %, and the remaining portion was composed of Fe and inevitable impurities was manufactured. Subsequently, the slab heating (step S1), the hot rolling (step S2), the annealing (step S3) and the cold rolling (step S4) were performed in accordance with the flowchart illustrated in FIG. 8. The thickness of the steel strip after the cold rolling was set to be 0.23 mm. Next, the annealing (step S5) and the nitriding process (step S6) were performed, and the C content was set to be 0.001 mass %, and the N content was set to be 0.02 mass % in the steel strip. Subsequently, the coating and the drying of the annealing separating agent of which major constituent was MgO were performed, and thereafter, the switching temperatures to the $H_2$ gas atmosphere were set as listed in table 2, to perform the finish annealing (step S7). In the finish annealing, first, the heating was started in the atmosphere in which the rate of $N_2$ gas was 25 volume %, and the remaining was $H_2$ gas. The oxygen potential at the temperature of 850° C. or less was adjusted to be 0.1. Besides, a rate of heating was set to be 15° C./h. The atmosphere was switched into the $H_2$ gas atmosphere during the heating, and the heating was further performed up to 1200° C., and the steel strip was kept at 1200° C. for 20 hours. Note that in a comparative example No. 1, the switching to the $H_2$ gas atmosphere was performed at 1200° C., and the steel strip was kept at 1200° C. for 20 hours as it was. After the keeping for 20 hours, the steel strip was cooled to be a room temperature. Next, unreacted annealing separating agent was removed, and evaluations of the steel strip and the glass coating film were performed. The results are listed in the table 2. A circle mark of "glass coating film state" in the table 2 represents that the number of defects of the glass coating film per 1 $cm^2$ was "0" (zero), and a color tone of the glass coating film was gray as a result of a surface observation. A triangular mark represents that the number of the defects was one or "0" (zero), and the glass coating film was totally white tinged and the glass coating film was thin. A cross mark represents that the number of defects was two or more.

TABLE 2

| | No. | ATMOSPHERE SWITCHING TEMPERATURE (° C.) | AGGREGATED PORTION RATIO | GLASS COATING FILM STATE | $B_8$ (T) |
|---|---|---|---|---|---|
| COMPARATIVE | 1 | 1200 | 0.27 | X | 1.92 |
| EXAMPLE | 2 | 1150 | 0.18 | Δ | 1.92 |
| EXAMPLE | 3 | 1100 | 0.12 | ○ | 1.91 |
| | 4 | 1050 | 0.12 | ○ | 1.93 |
| | 5 | 1000 | 0.08 | ○ | 1.91 |
| COMPARATIVE | 6 | 950 | 0.10 | Δ | 1.88 |
| EXAMPLE | 7 | 900 | 0.13 | Δ | 1.85 |

As listed in the table 2, the aggregated portion ratio was lower as the switching temperature was lower within the range of 1000° C. or more. Besides, the aggregated portion ratios were particularly high and many defects of the glass coating film were observed in the comparative examples No. 1 and No. 2, in which the switching temperatures exceeded an upper limit of the range of the present invention. On the other hand, the aggregated portion ratios were 0.15 or less and good glass coating films were obtained in examples No. 3, No. 4, and No. 5.

Besides, the aggregated portion ratios were low but the glass coating films were thin in comparative examples No. 6 and No. 7, of which switching temperatures were less than a lower limit of the range of the present invention. Besides, magnetic flux densities $B_8$, when they were excited at 800 A/m, were low. It is conceivable that this is because the secondary recrystallization was unstable and fine crystal orientation could not be obtained. Note that the magnetic flux density $B_8$ is a magnetic flux density when it is excited at 800 A/m.

Example 2

A slab containing C: 0.05 mass %, Si: 3.2 mass %, Mn: 0.09 mass %, P: 0.02 mass %, S: 0.006 mass %, Al: 0.026 mass %, N: 0.009 mass %, and Cr: 0.1 mass %, and the remaining portion was composed of Fe and inevitable impurities was manufactured. Subsequently, the slab heating (step S1), the hot rolling (step S2), the annealing (step S3) and the cold rolling (step S4) were performed in accordance with the flowchart illustrated in FIG. 8. The thickness of the steel strip after the cold rolling was set to be 0.23 mm. Next, the annealing (step S5) and the nitriding process (step S6) were performed, and the C content was set to be 0.001 mass %, and the N content was set to be 0.02 mass % in the steel strip. Subsequently, the coating and the drying of the annealing separating agent of which major constituent was MgO were performed, and thereafter, the oxygen potentials (P ($H_2O$)/P ($H_2$)) in the heating were set as listed in table 3, and the finish annealing (step S7) was performed. In the finish annealing, first, the heating was started in the atmosphere in which the rate of $N_2$ gas was 25 volume %, and the remaining was $H_2$ gas. The oxygen potential at the temperature of 850° C. or less was adjusted by a change of a dew point of the atmosphere. Note that the heating was started in the $N_2$ gas atmosphere in a comparative example No. 14. Besides, the rate of heating was set to be 15° C./h. The atmosphere was switched into the $H_2$ gas atmosphere at the temperature of 1050° C., and the heating was further performed up to 1200° C., and the steel strip was kept at 1200° C. for 20 hours. After the keeping for 20 hours, the steel strip was cooled to be a room temperature. Next, unreacted annealing separating agent was removed, and evaluations of the steel strip and the glass coating film were performed. The results are listed in the table 3. The circle mark of "glass coating film state" in the table 3 represents that the number of defects of the glass coating film per 1 $cm^2$ was "0" (zero), and the color tone of the glass coating film was gray as the result of the surface observation. The triangular mark represents that the number of the defects was one or "0" (zero), and the glass coating film was totally white tinged and the glass coating film was thin. The cross mark represents that the number of defects was two or more.

TABLE 3

| | No. | OXYGEN POTENTIAL | AGGREGATED PORTION RATIO | GLASS COATING FILM STATE | $B_8$ (T) |
|---|---|---|---|---|---|
| COMPARATIVE EXAMPLE | 11 | 0.03 | 0.19 | X | 1.88 |
| EXAMPLE | 12 | 0.06 | 0.13 | ○ | 1.92 |
| | 13 | 0.18 | 0.09 | ○ | 1.92 |
| COMPARATIVE EXAMPLE | 14 | 1 or more | 0.10 | Δ | 1.93 |

As listed in the table 3, the aggregated portion ratio was high and many defects of the glass coating film were observed in a comparative example No. 11, of which oxygen potential was less than a lower limit of a range of the present invention. Besides, the glass coating film was thin. The aggregated portion ratio was low but the glass coating film was too thick in a comparative example No. 14, of which oxygen potential exceeded an upper limit of the range of the present invention. This leads to deterioration of a space factor. Besides, a color tone defect was also observed. On the other hand, the aggregated portion ratios were low and the defects of the glass coating films were not observed in examples No. 12 and No. 13. Besides, external appearances thereof were fine.

INDUSTRIAL APPLICABILITY

The present invention can be used in, for example, an electrical steel sheet manufacturing industry and an electrical steel sheet using industry.

The invention claimed is:

1. A manufacturing method of a grain-oriented electrical steel sheet, comprising:

forming an oxide layer at a surface of a steel strip;

nitriding the steel strip;

after forming the oxide layer and nitriding the steel strip, coating the steel strip with an annealing separating agent containing MgO; and after coating the steel strip, forming a forsterite based glass coating film using the oxide layer at the surface of the steel strip, wherein the step of forming the forsterite based glass coating film comprises:

heating the coated steel strip by starting at a first temperature of 850° C. or less and increasing the first temperature to a second temperature of 1000° C. to 1100° C. in a mixed gas atmosphere consisting essentially of $H_2$ gas and $N_2$ gas in which a rate of $N_2$ gas is 20 volume % or more; and next switching the atmosphere into $H_2$ gas atmosphere at the second temperature of 1000° C. to 1100° C., wherein an oxygen potential P ($H_2O$)/P ($H_2$) is set to be 0.05 to 0.3 when the temperature is 850° C. or less during the heating in the mixed gas atmosphere.

2. The manufacturing method of a grain-oriented electrical steel sheet according to claim 1, further comprising:

making primary recrystallization occur in the steel strip during the time period of forming the oxide layer; and making secondary recrystallization occur in the steel strip during the time period of forming the forsterite based glass coating film.

* * * * *